US009975733B2

(12) United States Patent
Cunningham et al.

(10) Patent No.: US 9,975,733 B2
(45) Date of Patent: May 22, 2018

(54) ELEVATOR SAFETY DEVICE

(71) Applicants: Kevin Cunningham, Elburn, IL (US); Timothy Toan, Oak Park, IL (US)

(72) Inventors: Kevin Cunningham, Elburn, IL (US); Timothy Toan, Oak Park, IL (US)

(73) Assignees: Kevin Cunningham, Elburn, IL (US); Timothy Toan, Oak Park, IL (US)

( * ) Notice: Subject to any disclaimer, the term of this patent is extended or adjusted under 35 U.S.C. 154(b) by 473 days.

(21) Appl. No.: 14/605,136

(22) Filed: Jan. 26, 2015

(65) Prior Publication Data

US 2016/0214834 A1 Jul. 28, 2016

(51) Int. Cl.
*B66B 1/32* (2006.01)
*B66B 5/18* (2006.01)

(52) U.S. Cl.
CPC ..... *B66B 5/18* (2013.01)

(58) Field of Classification Search
CPC ..... B66B 5/18
USPC ..... 187/247, 277, 288, 289, 391, 393, 285
See application file for complete search history.

(56) References Cited

U.S. PATENT DOCUMENTS 313,451 A 3/1885 Rogers
823,720 A 8/1906 Fullenlove
5,014,828 A * 5/1991 Baldassarre ..... B66B 5/18 187/288
5,033,587 A * 7/1991 Nakai ..... B66B 11/0407 187/288
5,117,946 A * 6/1992 Traktovenko ..... B66B 7/046 187/410
5,145,035 A 9/1992 Garrido
5,648,644 A * 7/1997 Nagel ..... B66B 5/18 187/288
5,693,919 A * 12/1997 Sager ..... B66B 5/027 187/282
6,193,026 B1 * 2/2001 Sevilleja ..... B60T 13/22 187/288
6,318,505 B1 11/2001 De Angelis
6,830,132 B1 * 12/2004 Kang ..... B66B 9/022 187/271
7,299,898 B2 * 11/2007 Husmann ..... B66B 5/20 187/365
7,434,644 B2 10/2008 Wier
7,533,763 B2 * 5/2009 Kattainen ..... B66B 1/28 187/287
7,617,911 B2 * 11/2009 Mattila ..... B66B 5/0031 187/288
7,740,110 B2 6/2010 Kattainen
(Continued)

FOREIGN PATENT DOCUMENTS

EP 2 107 029 A1 10/2009
JP H4-20470 1/1992

OTHER PUBLICATIONS

H-W Equipment, Traction Machines-Geared Overhead Traction Machines.
International Search Report and Written Opinion.

*Primary Examiner* — Anthony Salata
(74) *Attorney, Agent, or Firm* — Michael P. Mazza, LLC

(57) ABSTRACT

One or more hydraulically-powered braking assemblies mounted on the cross-rail or safety plank of a traction-type or hydraulic-type elevator car, and designed to selectively brake on a guide rail of the elevator car upon detection of a safety condition.

12 Claims, 4 Drawing Sheets

(56) References Cited

U.S. PATENT DOCUMENTS

| | | | | |
|---|---|---|---|---|
| 7,775,330 | B2 * | 8/2010 | Kattainen | B66B 5/04 187/287 |
| 7,819,229 | B2 * | 10/2010 | Hanninen | B66B 5/02 187/288 |
| 8,210,311 | B1 * | 7/2012 | Rice | A62B 1/20 182/100 |
| 8,235,180 | B2 | 8/2012 | Kattainen | |
| 8,256,579 | B2 | 9/2012 | Jia | |
| 8,261,886 | B2 * | 9/2012 | Kigawa | B66B 5/00 187/288 |
| 8,272,432 | B2 | 9/2012 | Takahashi | |
| 8,315,996 | B2 | 11/2012 | Hashimoto | |
| 8,439,168 | B2 | 5/2013 | Kondo | |
| 8,517,150 | B2 * | 8/2013 | Grundmann | B66B 5/18 187/288 |
| 8,573,365 | B2 | 11/2013 | Ito | |
| 8,584,812 | B2 | 11/2013 | Dorsch | |
| 8,646,580 | B2 | 2/2014 | Rossignol | |
| 8,869,945 | B2 * | 10/2014 | Harkonen | B66B 1/28 187/288 |
| 2002/0112929 | A1 * | 8/2002 | Koshak | B66B 1/32 188/67 |
| 2009/0032340 | A1 | 2/2009 | Smith | |
| 2010/2013016 | | 8/2010 | Hult | |
| 2015/0251876 | A1 * | 9/2015 | Fauconnet | B66B 5/18 187/357 |
| 2016/0325965 | A1 * | 11/2016 | Haapaniemi | B66B 5/0062 |

* cited by examiner

ELEVATOR SAFETY DEVICE

BACKGROUND OF THE INVENTION

The present invention generally relates to devices for controlling the movement of elevators, and more specifically to an elevator safety device.

Archimedes is said to have built the first elevator in about 236 BC. In 1852, Elisha Otis introduced the safety elevator, which prevented the fall of the cab if the cable broke. The design of the Otis safety elevator is somewhat similar to one type still used today: a governor device engages knurled roller(s), locking the elevator to its guides should the elevator descend at excessive speed. Otis demonstrated his safety device at the New York exposition in the Crystal Palace in a dramatic, death-defying presentation in 1854, and the first such passenger elevator was installed at 488 Broadway in New York City on Mar. 23, 1857. The first electric elevator was built by Werner von Siemens in 1880 in Germany. The safety and speed of electric elevators were significantly enhanced by Frank Sprague, who added floor control, automatic elevators, acceleration control of cars, and safeties. His elevator ran faster and with larger loads than hydraulic or steam elevators, and 584 electric elevators were installed before Sprague sold his company to the Otis Elevator Company in 1895. Sprague also developed the idea and technology for multiple elevators in a single shaft. In 1882, when hydraulic power was a well-established technology, a company later named the London Hydraulic Power Company was formed, and constructed a network of high-pressure mains on both sides of the Thames which, ultimately, extended to 184 miles and powered some 8,000 machines, predominantly elevators (lifts) and cranes. In 1874, J. W. Meaker patented a method which permitted elevator doors to open and close safely (U.S. Pat. No. 147,853). In 1887, Alexander Miles of Duluth, Minn. patented an elevator with automatic doors that would close off the elevator shaft.

Today, elevators are typically powered by electric motors that either drive traction cables or counterweight systems like a hoist, or pump hydraulic fluid to raise a cylindrical piston like a jack. A modern-day elevator consists of a cab (also called a "cage" or "car") mounted on a platform within an enclosed space called a shaft or "hoistway." In the past, elevator drive mechanisms were powered by steam and water hydraulic pistons or by hand. In a "traction" elevator, cars are pulled up by means of steel ropes rolled over a deeply-grooved pulley or "sheave." The weight of the car is balanced by a counterweight. Sometimes, two elevators are built so that their cars always move synchronously in opposite directions, and function as each other's counterweight. The friction between the ropes and the pulley furnishes the traction which gives this type of elevator its name.

Hydraulic elevators use hydraulic power to pressurize an above-ground or in-ground piston to raise and lower the car. Roped hydraulics use a combination of both ropes and hydraulic power to raise and lower cars. Recent innovations include permanent magnet motors, machine room-less rail (MRL) mounted gearless machines, and microprocessor controls.

MRL elevators are designed so that most of the components fit within the shaft containing the elevator car, while a small cabinet houses the elevator controller. Other than the machinery in the hoistway, the equipment is similar to a normal traction elevator. Benefits of an MRL elevator include: more usable space; uses less energy (70-80% less than hydraulic elevators); uses no oil; all components are above-ground similar to roped hydraulic-type elevators (removing the environmental concern created by hydraulic cylinders used on direct hydraulic-type elevators stored underground); slightly lower cost than other elevators; and can operate at faster speeds than hydraulics but not normal traction units. Detriments of MRL elevators include: equipment can be harder to service and maintain, and no code has been approved for the installation of residential MRL elevator equipment.

The technology used in new installations depends on a variety of factors. Hydraulic elevators are cheaper, but installing cylinders greater than a certain length becomes impractical for very-high lift hoistways. For buildings over about 7-stories, traction elevators must be employed instead. Hydraulic elevators are usually slower than traction elevators.

Elevators are a candidate for mass customization. There are economies to be made from mass production of the components, but each building comes with its own requirements, such as a different number of floors, varying well dimensions, and differing usage patterns.

A more detailed discussion of conventional elevator design now follows, which will be helpful in understanding the invention and its advantages.

Traction Elevators

Geared traction elevators are driven by AC or DC electric motors. Geared elevators use worm gears to control mechanical movement of elevator cars by "rolling" steel hoist ropes over a drive sheave which is attached to a gearbox driven by a high-speed motor. These machines are generally the best option for basement or overhead traction use for speeds up to 500 feet per minute (3 m/s). Historically, AC motors were used for single- or double-speed elevator machines on the grounds of cost and lower-usage applications where car speed and passenger comfort were less of an issue. For higher-speed, larger-capacity elevators, the need for infinitely-variable speed control over the traction machine becomes an issue, and DC machines powered by an AC/DC motor generator have been the preferred solution. The MG set also typically powered the relay controller of the elevator, which has the added advantage of electrically isolating the elevators from the rest of a building's electrical system, thus eliminating the transient power spikes in the building's electrical supply caused by the motors starting and stopping (causing lighting to dim every time the elevators are used for example), as well as interference to other electrical equipment caused by the arcing of the relay contactors in the control system.

The widespread availability of variable frequency AC drives has allowed AC motors to be used universally, bringing with it the advantages of the older motor-generator, DC-based systems, without the penalties in terms of efficiency and complexity. Older MG-based installations are gradually being replaced in older buildings due to their poor energy efficiency.

Gearless traction elevators are low-speed (low-RPM), high-torque electric motors powered either by AC or DC. In this case, the drive sheave is directly attached to the end of the motor. Gearless traction elevators can reach speeds of up to 2,000 feet per minute (10 m/s), or even higher. A brake is mounted between the motor and drive sheave (or gearbox) to hold the elevator stationary at a floor. This brake is usually an external drum type and is actuated by spring force and held open electrically; a power failure will cause the brake to engage and prevent the elevator from falling.

With either geared or gearless traction elevators, cables are attached to a hitch plate on top of the cab or may be "underslung" below a cab, and then looped over the drive sheave to a counterweight attached to the opposite end of the cables, which reduces the amount of power needed to move the cab. The counterweight is located in the hoistway and rides a separate railway system; as the car goes up, the counterweight goes down, and vice versa. This action is powered by the traction machine which is directed by the controller, which is typically a relay logic or computerized device that directs starting, acceleration, deceleration and stopping of the elevator cab. The weight of the counterweight is typically equal to the weight of the elevator cab plus 40-50% of the capacity of the elevator. The grooves in the drive sheave are specially designed to prevent the cables from slipping. "Traction" is provided to the ropes by the grip of the grooves in the sheave. As the ropes age and the traction grooves wear, some traction is lost and the ropes must be replaced and the sheave repaired or replaced. Sheave and rope wear may be significantly reduced by ensuring that all ropes have equal tension, thus sharing the load evenly. Rope tension equalization may be achieved using a rope tension gauge, and is a simple way to extend the lifetime of the sheaves and ropes.

Elevators with more than 100 feet (30 m) of travel have a system called compensation. This is a separate set of cables or a chain attached to the bottom of the counterweight and the bottom of the elevator cab. This makes it easier to control the elevator, as it compensates for the differing weight of cable between the hoist and the cab. If the elevator cab is at the top of the hoist-way, there is a short length of hoist cable above the car and a long length of compensating cable below the car and vice versa for the counterweight. If the compensation system uses cables, there will be an additional sheave in the pit below the elevator, to guide the cables. If the compensation system uses chains, the chain is guided by a bar mounted between the counterweight railway lines.

Hydraulic Elevators

Conventional hydraulic elevators use an underground cylinder, and are quite common for low level buildings with 2-5 floors (sometimes but seldom up to 6-8 floors), and have speeds of up to 200 feet per minute (1 m/s). Holeless hydraulic elevators were developed in the 1970s, and use a pair of above-ground cylinders, which makes it practical for environmentally or cost-sensitive buildings with 2, 3, or 4 floors. Roped hydraulic elevators use both above-ground cylinders and a rope system, allowing the elevator to travel further than the piston has to move.

The low mechanical complexity of hydraulic elevators in comparison to traction elevators makes them ideal for low rise, low traffic installations. They are less energy efficient: as the pump works against gravity to push the car and its passengers upwards; this energy is lost when the car descends on its own weight. The high current draw of the pump when starting up also places higher demands on a building's electrical system. There are also environmental concerns should the lifting cylinder leak fluid into the ground.

The modern generation of low cost, machine room-less traction elevators made possible by advances in miniaturization of the traction motor and control systems challenges the supremacy of the hydraulic elevator in their traditional market niche. However, hydraulically-controlled systems generally allow for greater control than traction elevators and make it possible to safety move the elevator to a controlled door zone for safe release form the elevator.

Controlling Elevators

Early elevators had no automatic landing positioning. Elevators were operated by elevator operators using a motor controller. The controller was contained within about a 1' by 2' cylindrical container operated using a projecting handle. This allowed some control over the energy supplied to the motor (located at the top of the elevator shaft or beside the bottom of the elevator shaft) and so enabled the elevator to be accurately positioned, if the operator was sufficiently skilled. More typically, the operator would have to "jog" the control to get the elevator reasonably close to the landing point and then direct the outgoing and incoming passengers to "watch their step." Some older freight elevators are controlled by switches operated by pulling on adjacent ropes. Safety interlocks ensure that the inner and outer doors are closed before the elevator is allowed to move. Most older, manually-controlled elevators have been retrofitted with automatic or semi-automatic controls.

Automatic elevators began to appear as early as the 1930s. Their development was hastened by striking elevator operators taking advantage of large cities such as New York and Chicago dependent on skyscrapers (and therefore their elevators). These electromechanical systems used relay logic circuits of increasing complexity to control the speed, position and door operation of an elevator or bank of elevators. Relay-controlled elevator systems remained common until the 1980s, when they were gradually replaced with solid-state microprocessor-based controls, which are now the industry standard.

General Elevator Controls

A typical modern passenger elevator includes an overload sensor which prevents the elevator from moving until any excess load has been removed, and which may trigger a voice prompt or buzzer alarm and/or trigger a "full car" indicator, indicating the car's inability to accept more passengers until some are unloaded. In addition to such comforts as electric fans and air conditioning units, modern elevators also typically include a control panel with call buttons to choose a floor, some of which may include key switches (to control access). In some elevators, certain floors may be inaccessible unless a security card is swiped or a password is entered, or both.

A set of doors may be kept locked on each floor to prevent unintentional access into the elevator shaft. The door may be unlocked and opened by a machine sitting on the roof of the car, which may also drive the doors that travel with the car. Door controls may be provided to immediately close or reopen the doors, although the button to close them immediately is often disabled during normal operations, especially on more recent elevators. Objects in the path of the moving doors will either be detected by sensors or physically activate a switch that reopens the doors. Otherwise, the doors will close after a preset time. Some elevators are configured to remain open at the floor until they are required to move again.

Elevators in high traffic buildings often have a "nudge" function, which will close the doors at a reduced speed, and sound a buzzer if the "door open" button is being deliberately held down, or if the door sensors have been blocked for too long a time. A stop switch (not allowed under British regulations) may also be provided to halt the elevator while in motion, and to hold an elevator open while freight is loaded. Keeping an elevator stopped for too long may set off an alarm. Unless local codes require otherwise, this will most likely be a key switch. An alarm button or switch, or a telephone, may also be provided, which passengers can use to warn the premises manager that they have been trapped in the elevator. Other controls may be provided as well.

Elevator Safety

Statistically speaking, cable-borne elevators are extremely safe. Of the 20 to 30 elevator-related deaths each year, most of them are maintenance-related, such as technicians leaning too far into the shaft or getting caught between moving parts, and most of the rest are attributed to other kinds of accidents, such as people stepping blindly through doors that open into empty shafts or being strangled by scarves caught in the doors. While it is possible, though unlikely, for an elevator's cable to snap, all elevators in the modern era have been fitted with several safety devices which prevent the elevator from simply free-falling and crashing. An elevator cab is typically borne by six or eight hoist cables, each of which is capable on its own of supporting the full load of the elevator plus twenty-five percent more weight. In addition, there is a device which detects whether the elevator is descending faster than its maximum designed speed; if this happens, a device called a "governor" causes copper brake shoes to clamp down along the vertical rails in the shaft, stopping the elevator quickly, but not so abruptly as to cause injury. In addition, a hydraulic or mechanical buffer may be installed at the bottom of the shaft to somewhat cushion any impact.

Early hydraulic elevators built prior to a code change in 1972 were subject to possible catastrophic failure. The code had previously required only single-bottom hydraulic cylinders. In the event of a cylinder breach, an uncontrolled fall of the elevator might result. Because it is impossible to verify the system completely without a pressurized casing, it is necessary to remove the piston to inspect it. The cost of removing the piston is such that it makes no economic sense to re-install the old cylinder; therefore it is necessary to replace the cylinder and install a new piston. Another solution to protect against a cylinder blowout is to install a "life jacket." This is a device which, in the event of an excessive downward speed, clamps onto the cylinder and stops the car. A device known as a rupture valve is often attached to the hydraulic inlet/outlet of the piston and can be adjusted for a maximum flow rate. If a pipe or hose were to rupture, the flow rate of the rupture valve will surpass a set limit and mechanically stop the outlet flow of hydraulic fluid, thus stopping the piston and the car in the down direction.

ASME Codes

The American Society of Mechanical Engineers (ASME) has a specific section of Safety Code (ASME A17.1, Section 5.3) which addresses Residential Elevators. This section allows for different parameters to alleviate design complexity based on the limited use of a residential elevator by a specific user or user group. Section 5.3 of the ASME A17.1 Safety Code is for Private Residence Elevators, which does not include multi-family dwellings. Some types of residential elevators do not use a traditional elevator shaft, machine room, and elevator hoistway. This allows an elevator to be installed where a traditional elevator may not fit, and simplifies installation. The ASME Board first approved machine-room-less (MRL) systems in a revision of the ASME A17.1 in 2007. MRL elevators have been available commercially since the mid 1990s; however cost and overall size prevented their adoption to the residential elevator market until around 2010. (As of 2006, all states except Kansas, Mississippi, North Dakota, and South Dakota have adopted some version of ASME codes, though not necessarily the most recent.) Passenger elevators must also conform to many ancillary building codes including the Local or State building code, National Fire Protection Association standards for Electrical, Fire Sprinklers and Fire Alarms, Plumbing codes, and HVAC codes.

Existing Safety Concerns

Safety concerns for elevators remain. For example, while modern codes have regulated unintended and uncontrolled movement of elevators in the "down" direction, as to the about 300,000 traction elevators in the U.S., as well as the about 600,000 hydraulic elevators in the U.S., unintended and uncontrolled elevator movement is not regulated in the "up" direction. In addition, there is a significant void in the regulation of hydraulic elevators, as the codes currently require mechanical safety devices, such as a rope gripper on traction elevators, to control downward unintended and/or uncontrolled elevator movement, but such mechanical safety devices are often not useable with hydraulic elevators, and no such codes govern such movement for hydraulic elevators. As a result, hydraulic elevators often include no safety device, or improper safety devices, for unintended or uncontrolled movement, such as may be caused by catastrophic failure of the hydraulic system. (As one example, piston grippers have been installed in lieu of a piston replacement required by code for hydraulic jack assemblies manufactured prior to 1972. The piston gripper has certain limitations based on physical space required for the unit. Activation of the roper gripper in most cases causes passengers entrapment.)

Additionally, all current safety systems, used with either traction-type or hydraulic-type elevators, create an abrupt stop, and also entrap the passengers within the elevator until maintenance or emergency personnel can move the car to an adjacent floor and pry open the doors, which can take hours.

Accordingly, it is one of the objects of the present invention to provide a safety system for unintended and/or uncontrolled elevator movement that is safer and less cumbersome to install than available such systems, and that may be provided either on new elevators or retrofit on older elevators.

It is another object of the present invention to provide a safety system which, when activated, will safely and smoothly guide an elevator car, under control, to the next available floor and immediately release its passengers.

It is still another object of the present invention to provide a safety system which may be easily installed on hydraulic elevators, as well as on geared and gearless traction elevators.

It is yet another object of the present invention to provide such a safety system which is both cost-efficient to manufacture and easy to install or retrofit.

Further objects of the present invention may be realized by embodiments which: monitor elevator safety circuits, the encoder, the door circuit and the brake or valve circuits; and provide battery back-up in case of power failure.

SUMMARY OF THE INVENTION

The objects mentioned above, as well as other objects, are solved by the present invention, which overcomes disadvantages of prior elevator safety devices, while providing new advantages not previously associated with them.

In a preferred embodiment of the invention, an elevator safety device for an elevator car is provided, and includes one or more hydraulically-powered braking assemblies mounted on the cross-rail or safety plank of the elevator car and designed to selectively brake on a guide rail of the elevator car upon detection of a safety condition. The elevator car may be a traction-type or hydraulic-type elevator car. The one or more of the hydraulically-powered braking assemblies may also be mounted on the bottom of the elevator car, if desirable given the size and/or speed of the car design. Each braking assembly may include a roller guide in mechanical communication with the guide rail, and hydraulic disc brakes for braking on the guide rail. The roller guides may include shock-absorbing elements such as springs. In a particularly preferred embodiment, each roller guide includes three wheels to form a braking, roller guide assembly.

The safety condition whose detection results in actuation of the one or more braking assemblies may include one or more of the following conditions: the conditions of elevator hoist doors, and of elevator car doors; an elevator safety string; an elevator system encoder; brake inputs; valve inputs; and door circuits.

The elevator safety string may include safety circuits which monitor one or more of the following: reverse phase relay; top and bottom final; pit switch; car top stop switch; governor overspeed switch; safety operated switch; and drive ready relay.

Definition of Claim Terms

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Figure 1:
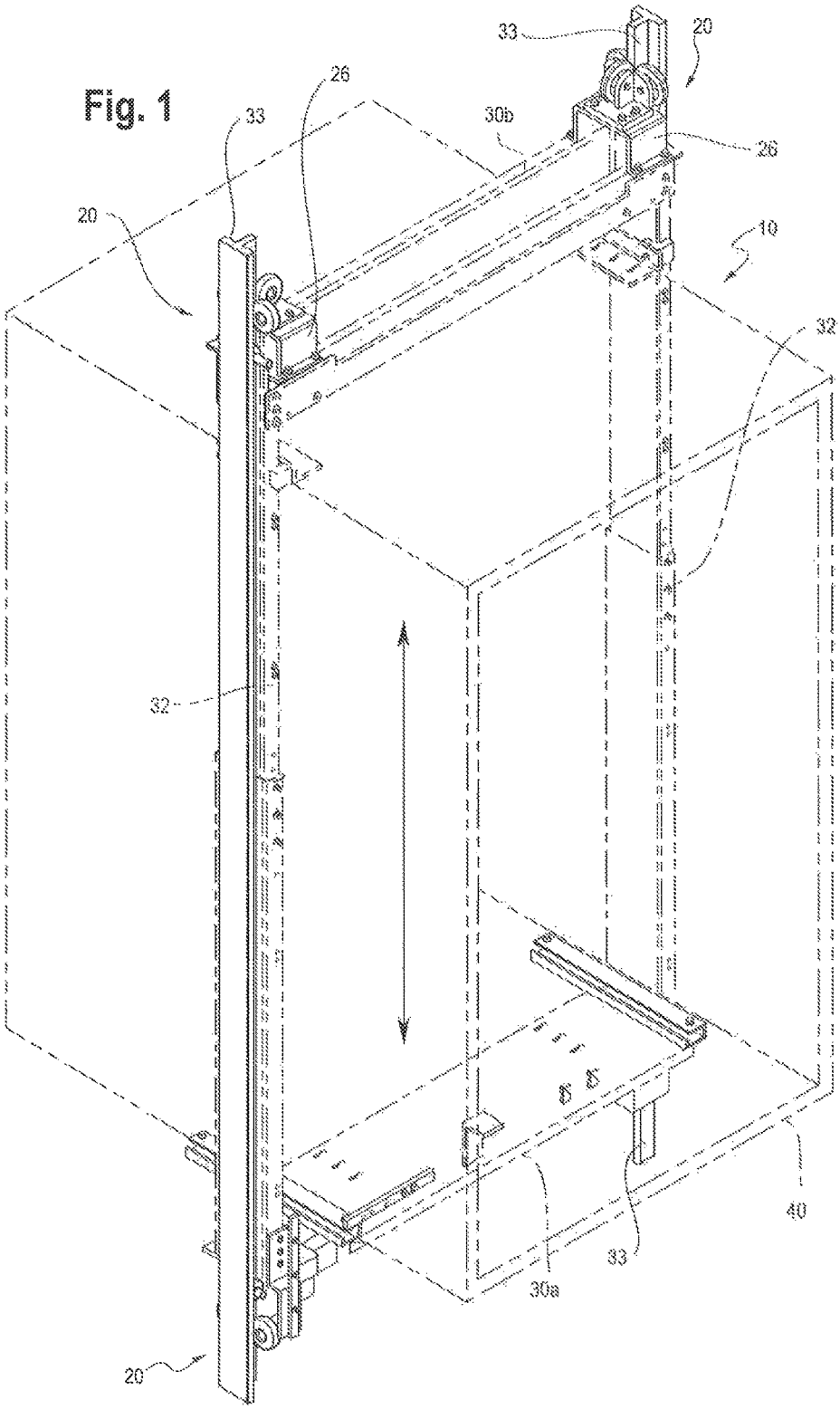
FIG. 1 is a perspective top and side view of one embodiment of the safety brake invention as shown for use with a traction elevator car.

Referring to FIG. 1, one embodiment of the elevator safety brake device of the present invention is shown, and designed generally with the reference numeral 20, designated for use with elevator car 10. Vertically-extending side rails or "stiles" 32 are structural members, such as U-shaped channels and, together with top cross rails 30*b* and bottom cross-rail 30*a*, together form the "sling" of elevator car 10. Elevator safety brakes 20 may be used to brake traction or hydraulic elevators. In the embodiment shown in the drawings, safety brakes 20 are used to brake a traction elevator car 10 with cross-rails 30 and guide rails 33 (The bottom cross-rail of a traction-type elevator is referred to in the claims as the "safety plank," while the bottom cross-rail of a hydraulic elevator is referred to here as a "bolster channel.").

Figure 7:
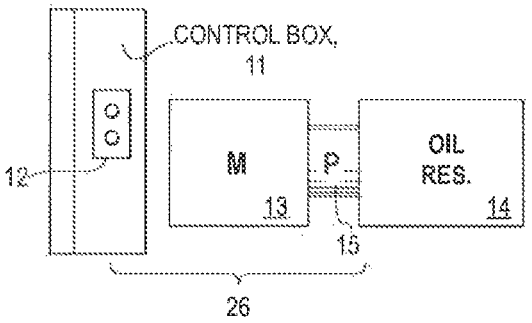
FIG. 7 is a schematic view of an embodiment of the control box and hydraulics that may be used to power and control the safety brake of the present invention.
Figure 8:
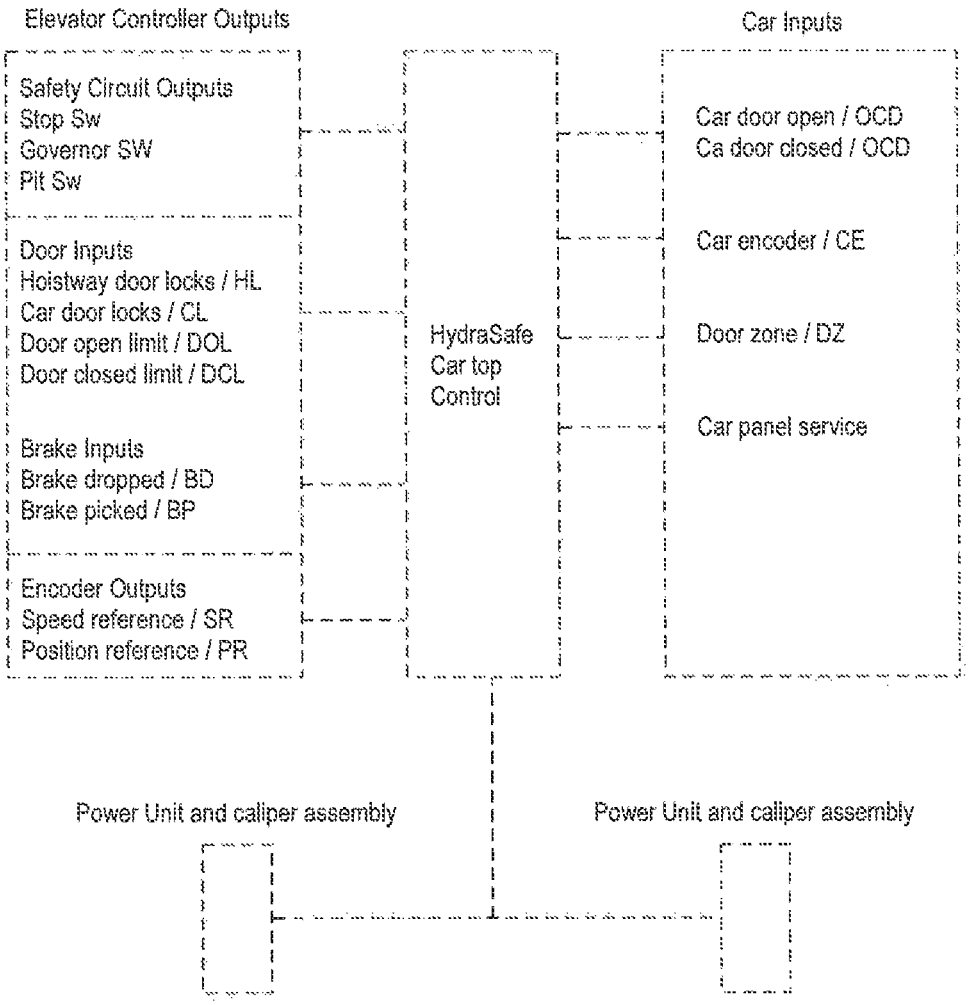
FIG. 8 is a schematic diagram showing various elevator controller outputs and elevator car inputs.

Referring to FIG. 7, control and power for safety brakes 20 may be provided, such as by using a control box 11 (with controls for hydraulic disc brakes 12), hydraulic valves 12, pump motor 13, an oil reservoir 14 in fluid communication with the pump motor, and an accumulator 15 for maintaining appropriate oil pressure in the lines. Hydraulic lines (not shown) may be used to provide pressurized oil between hydraulic valves/disc brakes 12 and braking control unit 26 of each safety brakes 20. Brakes 20 may consist of identical left and right safety devices located at opposing ends on the top of an elevator car 10, and attached to the cross-rail 30 of the car. (Alternatively, a pair of safety devices could be manufactured as an integral, single unit, connected by a rigid connecting plate spanning and connected to the cross-rail.)

Figure 2:
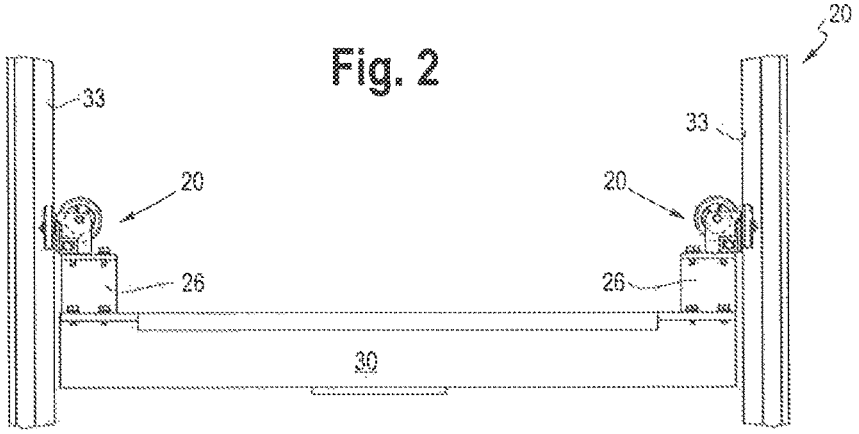
FIG. 2 is a partial front perspective view of the embodiment shown in FIG. 1.
Figure 3:
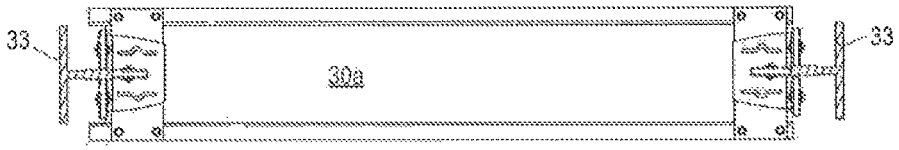
FIG. 3 is a top perspective view of the embodiment shown in FIG. 1.
Figure 4:
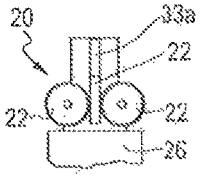
FIG. 4 is a partial side perspective view of the safety brake shown in FIG. 1.
Figure 5A:
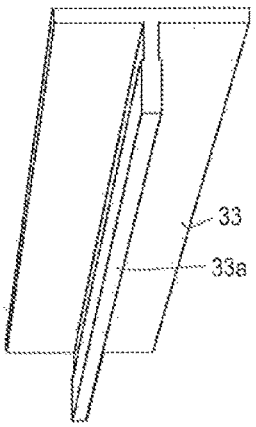
FIG. 5 is a partial, enlarged top and side perspective view of one of the safety brakes as it may be attached to a T-shaped cross-rail of an elevator car.
Figure 5B:
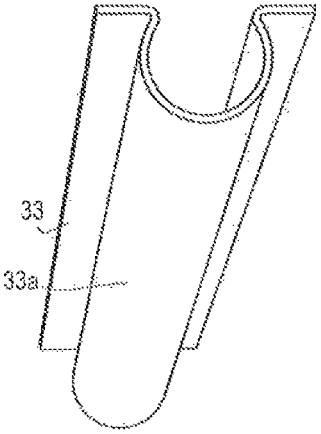
Figure 5:
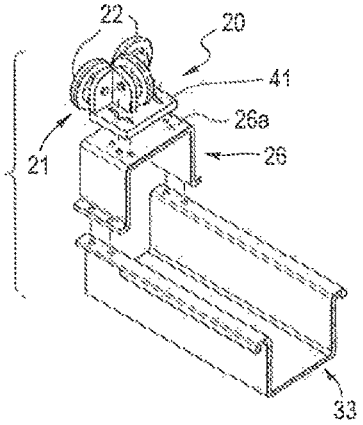
Figure 6:
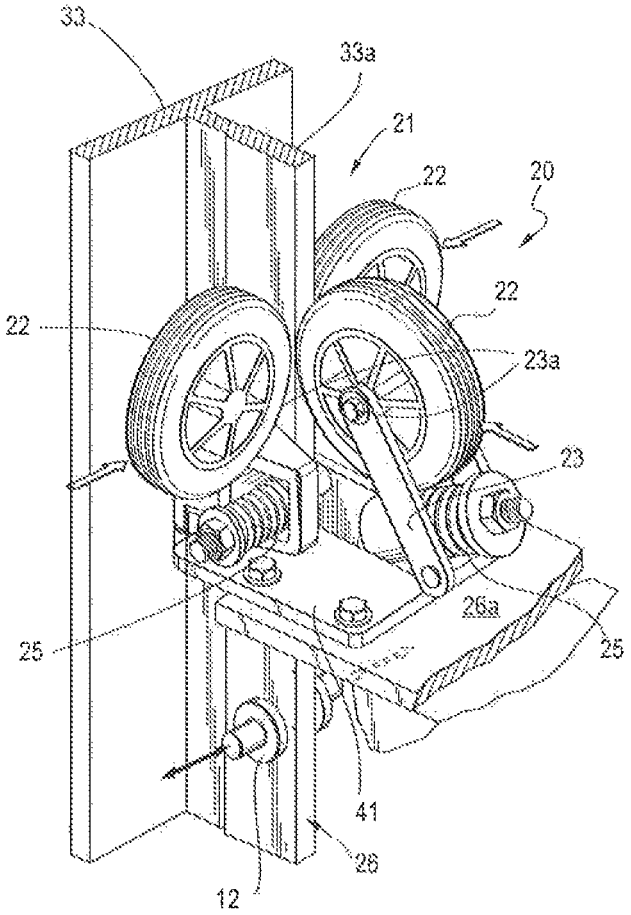
FIG. 6 is a partial, enlarged top and side perspective view of a safety brake and its surrounding environment as shown in FIG. 1.

Referring now to FIGS. 3-6, safety brakes 20 may each include a roller guide assembly 21, such as three rollers or wheels 22 mounted on arms 23, all carried by plate 41, which may be welded to an upper portion 26*a* (FIG. 6) of control unit 26, enabling the safety device to move the elevator car along guide rail 33. Roller guide assembly 21 may be designated so that wheels 22 selectively grab on portion 33*a* of guide rail 33. Shock-absorbing springs 25 may be mounted on arms 23 to dampen vibration. Hydraulic control unit 26 may be used to control the hydraulic brakes of roller guide assembly 20. As shown in FIG. 6, fasteners 23*a* may be used to connect arm 23 to wheel 22. Roller guide assembly 21 may be secured to control unit 26 (only one shown in FIG. 6) by drilling holes and using fasteners, or using clamping devices. Opposing disc brakes 12 may be attached to flange plate 41, on control unit 26, which may in turn be attached to a cross-rail 30 (see FIG. 2) as shown in FIG. 6, adjacent guide rail 33.

Flange plate 24 is preferably positioned relative to cross-rail 30 so that rollers 22 closely surround and hug vertical guide rail 33. Using an appropriate control scheme, hydraulic fluid can be selectively supplied to disc brakes 26, causing the opposing disc brakes to move toward each other and securely clamp on guide rail 33, stopping the elevator car when desired. Shock-absorbing rollers 22 ensure a smooth ride for the occupants of elevator car 10.

Those of ordinary skill in the art will now appreciate that using the present invention, a hydraulic disc braking system may be installed on the cross-head/cross-rail, below a roller guide assembly, so that the elevator car may be smoothly and selectively braked on the vertical guide rail. Alternatively, those of ordinary skill in the art will appreciate that if the safety braking system of the invention cannot be installed on the cross-head/cross-rail for some reason, or otherwise on the car top, then it may be installed on the existing safety plank (similar to cross-head, located just under the car, made up on the bottom cross-beams, and houses the existing safeties). Additionally, it will be understood that if the car size or speed requires more than just two safety brake units, four may be installed in each corner of the car.

Figure 5C:
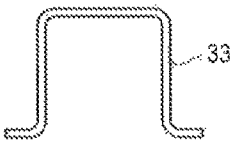
Figure 5D:
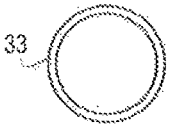

Persons of ordinary skill will also appreciate that the present invention may be advantageously employed with guide rails of different geometries other than the T-shaped geometry shown in FIG. 5, including those which are T-rail (FIG. 5*a*), omega-shaped (FIG. 5*b*), hat-shaped (FIG. 5*c*), round (FIG. 5*d*), etc. Flange plate 24 will be appropriately designed and shaped to fit this guide rail geometry. Additionally, it will also be understood that the rollers and disc brakes may be located in different orientations than those shown in the drawings, in order to accommodate the differing geometries of different guide rails.

It will be appreciated that on larger (e.g., freight) elevators and/or higher-speed elevators, it may be desirable to install an opposing pair of safety devices 20 on both the top and bottom of an elevator car 10.

Those of ordinary skill will appreciate that hydraulic disc brakes 26 may be "pulse" disc brakes (which operate similar to the ABS system on an automobile, except that the disc brakes are applied to the vertical steel guide rails associated with an elevator, instead of the discs associated with the wheels of an automobile). As one non-limiting example, a commercially available disc brake which may be used is made by MICO, Model Number 02-520-152.

Referring to FIG. 7, within control box 12 a controller, such as a programmable logic controller (PLC), may be located on the top of the elevator car and/or within the car. The PLC may be in serial communication with an elevator control panel located in the machine room or central control room of the building housing the elevator cars. The PLC may be provided with software enabling the control of the elevator systems described here. Safety devices 20 may be provided which, in addition to providing the controlled braking action mentioned above, may also be equipped to monitor one or more of the following, as is well known in the art: the elevator safety string; the elevator system encoder (a tapeless system may use, for example, an absolute encoder mounted on the governor and a four sensor selector on the car top to read the door zone magnet for each floor); brake inputs; valve inputs; and door circuits. (As is known in the art, a "safety string" may be initiated when a safety is open. Safety circuits may monitor the following, for example: reverse phase relay; top and bottom final; pit switch; car top stop switch; governor overspeed switch; safety operated switch; and drive ready relay. Here is an explanation of the function of each such safety circuit:

Reverse phase relay: Monitors the incoming power legs of the three-phase power source; if all three legs are not seen the unit goes into fault and opens the safety string.

Top and bottom final: Switches located just above the top floor and just below the bottom floor. If the elevator goes above the top floor by the code-required amount or below the bottom floor, they open the safety string.

Pit switch: An additional stop switch, located in the elevator pit for use by service personnel, Car top stop switch: An additional stop switch located on the car top and/or in the car, for use by service personnel; when activated, it opens the safety string.

Governor overspeed switch: This switch is located on the elevator governor and when the governor trips, it will open the safety string.

Safety-operated switch: Also known as the S.O.S. switch, it may be located on the safety plank under the elevator car; once the safeties are actuated, this switch opens the safety circuit.

Drive ready relay: A relay that instructs the elevator system that the drive is ready to run. This relay is driven by the internal safety circuits of the drive.

As a non-limiting example, independent signals from devices located on the elevator, and directly wired to the PLC, may be compared with elevator controls for redundancy, so that the elevator is not allowed to operate with crucial circuits jumped from the machine room. For example, in a preferred elevator system of the present invention, the actual condition of the elevator hoistway doors and the car door may be monitored. If the controller input indicates the doors are closed and does not see the same input from the car, the brakes may engage, indicating the system is jumped out. (This will be code-required when the 2013 U.S. code is enforced. Jumping of door circuits is a common practice in working on faulty door locks.) This will not only allow the circuit to be jumped safely, but it will also provide information to the failed lock. Once the jumper is installed, the technician at the elevator will be able to place the system on door lock test mode and manually run the car with the doors jumped out on inspection speed to find and repair the faulty door lock. The device will not reset until the controller circuits are restored. A USB port may be provided in the car operating panel for trouble-shooting and testing of safety devices 20. Thus, as one non-limiting example, and as likely required by 2013 codes, safety devices 20 will "know" when a door lock has "jumped out."

In a particularly preferred embodiment, a PLC will govern the operation of safety devices 20 in a manner which will permit the oversight and control of various elevator safety functions, such as: (1) if an overspeed condition is detected in either direction, safety devices 20 will gradually slow the elevator to the next available stop within the door zone and then remove the corresponding elevator(s) from service so that maintenance personnel may repair the elevator(s); (2) if the doors are open and excessive movement is detected, safety devices 20 may brake the elevator(s) in question after a set time and, sounding a warning, will also close the door(s) until the inputs are restored or manually reset; (3) if the doors are open and the brake input is not detected, safety devices 20 will immediately brake the elevator(s) until the brake signal is restored; and (4) if the system sees the elevator controls showing doors closed and the braking system does not have the closed signal from the car door, safety devices 20 will immediately brake the elevator(s) until the inputs are corrected.

The above description is not intended to limit the meaning of the words used in the following claims that define the invention. Persons of ordinary skill in the art will understand that a variety of other designs still falling within the scope of the following claims may be envisioned and used. It is contemplated that these additional examples, as well as future modifications in structure, function, or result to that disclosed here, will exist that are not substantial changes to what is claimed here, and that all such insubstantial changes in what is claimed are intended to be covered by the claims.

We claim:

1. An elevator safety braking device for use with a traction-type or hydraulic elevator car carried by opposing guide rails, wherein the elevator car has a mechanical safety brake designed to actuate if the elevator car exceeds a predetermined speed, or if a predetermined safety condition is triggered, comprising:

one or more hydraulically-powered braking assemblies mounted on at least top or bottom cross-rails of the elevator car, wherein the one or more braking assemblies function to selectively brake on one or more of the guide rails prior to actuation of the mechanical safety brake, and upon detection of a safety condition involving an uncontrolled or unintended movement of the elevator car other than that which would actuate the mechanical safety brake.

2. The elevator safety braking device of claim 1, wherein each of the one or more braking assemblies includes opposing roller guides, and each is in mechanical and frictional communication with a guide rail, and wherein the roller guides work in conjunction with hydraulic disc brakes.

3. The elevator safety braking device of claim 2, wherein one or more of the roller guides include shock-absorbing elements.

4. The elevator safety braking device of claim 2, wherein each of the roller guides includes at least three wheels.

5. The elevator safety braking device of claim 1, wherein the safety condition whose detection results in actuation of the one or more hydraulically-powered braking assemblies relates to one or more of the following conditions: the conditions of elevator hoist doors, or of elevator car doors.

6. The elevator safety braking device of claim 1, wherein the safety condition whose detection results in actuation of the one or more hydraulically-powered braking assemblies involves one or more of the following: an elevator safety string; an elevator system encoder; brake inputs; valve inputs; and door circuits.

7. The elevator safety braking device of claim 6, wherein the elevator safety string includes safety circuits which monitor one or more of the following: reverse phase relay; top and bottom final limit switches; pit switch; car top stop switch; governor overspeed switch; safety operated switch; and drive-ready output relay.

8. The elevator safety braking device of claim 3, wherein the shock-absorbing elements comprise springs.

9. The elevator safety braking device of claim 1, wherein the one or more braking assemblies may be used with guide rails having differing cross-sectional shapes, including cross-sectional shapes that are: T-shaped; hat-shaped; omega-shaped; and round.

10. The elevator safety braking device of claim 1, wherein use of the safety device allows a bypass of door lock inputs of the elevator car while operating manually at an inspection speed, enabling safe and controlled location and repair of a faulty door lock.

11. The elevator safety braking device of claim 1, wherein the device is retrofit to a preexisting traction-type or hydraulic elevator car.

12. The elevator safety braking device of claim 1, wherein the device is used with an existing traction-type or hydraulic elevator car.

* * * * *